US006449784B1

(12) United States Patent
Pelletz

(10) Patent No.: US 6,449,784 B1
(45) Date of Patent: Sep. 17, 2002

(54) EASY OPERATING DIVERTER TUB SPOUT

(76) Inventor: Leslie G. Pelletz, 19 Depot St., Natick, MA (US) 01569

( * ) Notice: Subject to any disclaimer, the term of this patent is extended or adjusted under 35 U.S.C. 154(b) by 0 days.

(21) Appl. No.: 10/002,836

(22) Filed: Nov. 1, 2001

Related U.S. Application Data

(60) Provisional application No. 60/247,315, filed on Nov. 10, 2000, and provisional application No. 60/299,999, filed on Jun. 20, 2001.

(51) Int. Cl.[7] ..... E03C 1/04; F16K 5/00
(52) U.S. Cl. ..... 4/675; 137/801
(58) Field of Search ..... 4/675, 678; 137/801, 137/359, 360

(56) References Cited

U.S. PATENT DOCUMENTS

| | | | | |
|---|---|---|---|---|
| 2,128,627 | A | * | 8/1938 | Vogt |
| 2,627,872 | A | * | 2/1953 | Gruen ..... 4/678 |
| 2,663,539 | A | * | 12/1953 | Kersten et al. |
| 3,576,197 | A | * | 4/1971 | Bastian |
| 3,801,997 | A | * | 4/1974 | Ward ..... 4/678 |
| 3,880,183 | A | * | 4/1975 | Humpert et al. |
| 3,906,990 | A | * | 9/1975 | Nelson |
| 4,171,005 | A | * | 10/1979 | Nicklas |
| D266,452 | S | | 10/1982 | Fleischman et al. |
| 4,606,370 | A | * | 8/1986 | Geipel et al. |
| D290,643 | S | | 6/1987 | Paul |
| D290,644 | S | | 6/1987 | Paul |
| D290,645 | S | | 6/1987 | Paul |
| D316,895 | S | | 5/1991 | Hill et al. |
| D317,350 | S | | 6/1991 | Freed |
| 5,279,005 | A | * | 1/1994 | Valley |
| D353,877 | S | | 12/1994 | Rogers |
| D361,624 | S | | 8/1995 | Fabian |
| D365,143 | S | | 12/1995 | Fabian |
| 5,608,928 | A | * | 3/1997 | Wang ..... 4/678 |
| 5,689,843 | A | * | 11/1997 | Duke et al. ..... 4/675 |
| D412,203 | S | | 7/1999 | Pitsch et al. |
| 6,009,904 | A | * | 1/2000 | Yang |
| D421,100 | S | | 2/2000 | Green et al. |
| D424,664 | S | | 5/2000 | Green et al. |
| D426,873 | S | | 6/2000 | Milrud et al. |
| D428,971 | S | | 8/2000 | Milrud et al. |

* cited by examiner

*Primary Examiner*—Charles R. Eloshway
(74) *Attorney, Agent, or Firm*—Norton R. Townsley; Belasco Jacobs & Townsley, LLP

(57) ABSTRACT

An essentially hollow housing inside of which is supported a ferrule, with female pipe threads for connecting to a water supply and a ball valve for turning the water supply on and off. The ball valve includes a handle, for operating the ball valve, which is supported exterior to the housing. At the end of the housing there is a spout for diverting water flow from the horizontal to the vertical. The handle may be shaped so that the condition of the valve (i.e. open or closed) may be readily determined. In an alternate embodiment there is a hand held shower connection that joins the ferrule and passes through the hollow housing at a compound angle at one side.

3 Claims, 7 Drawing Sheets

EASY OPERATING DIVERTER TUB SPOUT

CROSS-REFERENCE TO RELATED APPLICATION

This application claims the benefit of U.S. Provisional Application, Ser. No. 60/247,315, filed Nov. 10, 2000 and U.S. Provisional Application, Ser. No. 60/299,999, filed Jun. 20, 2000. The disclosures of these Provisional Applications are hereby specifically incorporated by reference.

BACKGROUND OF THE INVENTION

The present invention relates to the field of plumbing fixtures, and more particularly, to a diverter tub spout that is easy to switch with a ball valve.

Diverter tub spouts are well known and commonly in use in bathtub plumbing arrangements which include a shower head, to divert water from the spout to the shower head when desired. Such diverter spouts eliminate the need for a separate spout shower head selector control and allow savings on both installation and hardware costs. This water diversion from the tub spout to the shower head is provided, of course, by valve means that block water flow through the spout. The plumbing fixtures field long has recognized the advantages in reliability and ease of manufacture of water passage closure valves utilizing a floating, ball shaped valve member that utilizes the pressure force of the flowing water to seat against a valve surface. An example of such a valve arrangement is disclosed in U.S. Pat. No. 2,128,627, issued Aug. 30, 1938. Also, closure valves utilizing this principal have been used in diverter tub spouts as may be seen from the disclosure of U.S. Pat. No. 2,663,539, issued Dec. 22, 1953.

Certain problems in operation have been encountered, however, during use by consumers of prior art diverter tub spouts relative to three desirable features for these plumbing hardware items. First, it is desirable that no unwanted interruption of water flow through the tub spout, and sudden discharge through the shower head be experienced. In diverter tub spouts using a true free floating valve member design, it is possible in situations where high water line pressure exists or pressure surges are encountered, for low water pressure or turbulence resulting fluctuations in pressure to dislodge the floating valve member from its non-blocking storage position and result in an unwanted blockage of the spout water passage. Second, it is desirable that no unwanted interruption of water flow through the shower head be experienced through slippage of the valve in the diverter tub spout. Third, it is desirable that no water escape through the diverter tub spout while water flow through the shower head is desired. Escape of water from the diverter tub spout leads to waste of water and energy which is used to heat the water.

The prior art has taught the avoidance of the first problem by the use of mechanical valve control structure to hold physically the valve member away from the seat in the non-blocking mode. It has been found, however, that certain designs with such structure allow unwanted spout blockage due to slippage of mechanical valve stops in low pressure, turbulence and vibration situations. Other mechanical valve control structure, such as is disclosed in the previously mentioned U.S. Pat. No. 2,128,627, positively maintain the floating valve member remote from the valve seat.

There have been, in addition, several further attempts to solve the problems with diverter tub spouts. These are represented by U.S. Pat. Nos. 4,171,005, 5,279,005 and 6,009,904. However, these have failed to solve the basic problems with diverter tub spouts.

Some bathrooms do not have showers. Hand held showers are available for installation which provide the convenience of a shower without the installation expense. Hand held showers typically have a shower head with a handle and a connecting flexible hose. The lower end of the hose is typically provided with a ½" female thread for connection to the water system through a pipe, with a ½" male thread. Consequently, there is also a need for easy opening diverter tub spout with a hand held shower connection. In this way a hand held shower can be connected to the diverter tub spout.

Development of a diverter tub spout which can solve all the above identified problems represents a great improvement in the field of household plumbing fixtures and satisfies a long felt need of the plumber and homeowner.

SUMMARY OF THE INVENTION

The present invention has a hollow housing inside of which is supported a ferrule, with female pipe threads for connecting to a water supply and a ball valve for turning the water supply on and off. The ball valve includes a handle, for operating the ball valve, which is supported exterior to the housing. At the end of the housing there is a spout for diverting water flow from the horizontal to the vertical. The handle may be shaped so that the condition of the valve (i.e. open or closed) may be readily determined. An alternate embodiment comprises a hand held shower connection that joins the ferrule and passes through the hollow housing at a compound angle at one side. In addition, the ball valve is preferably designed to weep slightly in order to prevent water from standing in the shower riser for long periods when water is shut off.

It is, therefore, an object of this invention to provide an easy operating diverter tub spout that utilizes the ball valve principal to block water flow through the spout selectively, while eliminating the possibility of an unwanted blockage regardless of water passage pressure, turbulence or vibration conditions. Another object of this invention is to provide such a diverter tub spout wherein the ball valve member can be moved from its open to its closed position via an exteriorly arranged handle. Still another object of this invention is the provision of a diverter tub spout which does not leak, thus preventing loss of water and energy used to heat the water. Yet another object of this invention is the provision of a diverter tub spout having the advantages described above and that is simple in design, economical to manufacture and reliable in operation.

Whereas, as described above, there have been many prior designs for diverter tub valves, diverter tub valves which incorporates a ball valve have never before been conceived and produced. Moreover, a diverter tub valve incorporating a ball valve and hand held shower connection has never before been conceived and produced.

An appreciation of the other aims and objectives of the present invention and an understanding of it may be achieved by referring to the accompanying drawings and description of a preferred embodiment.

DETAILED DESCRIPTION OF THE PREFERRED EMBODIMENT

Figure 1:
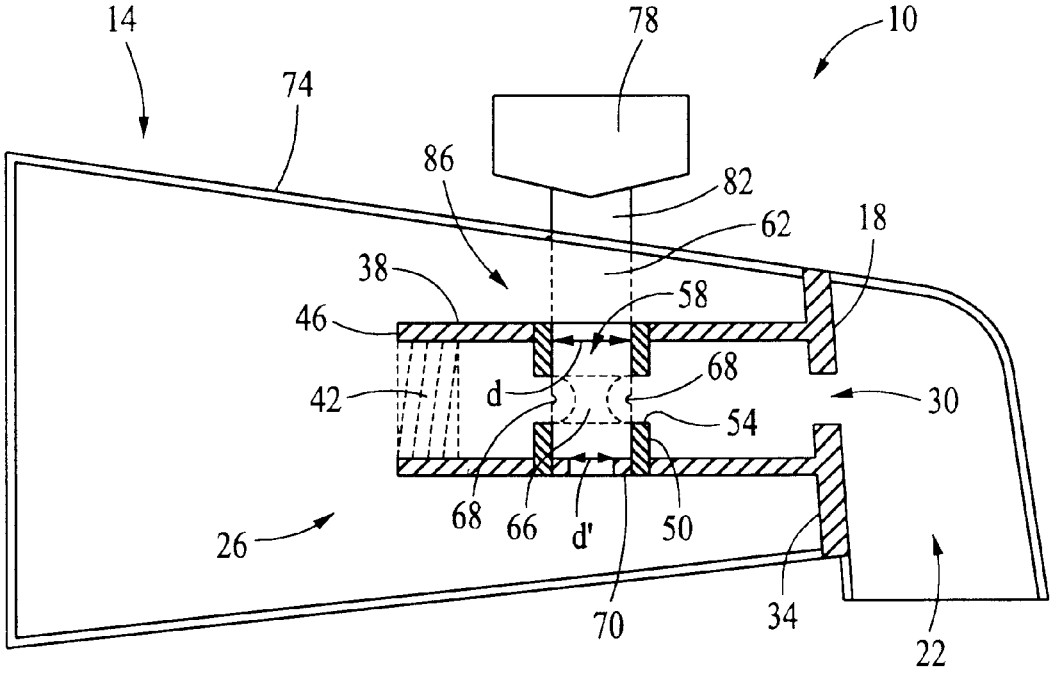
FIG. 1 is a vertical cross-sectional view of the diverter tub spout of this invention with the ball valve open.
Figure 2:
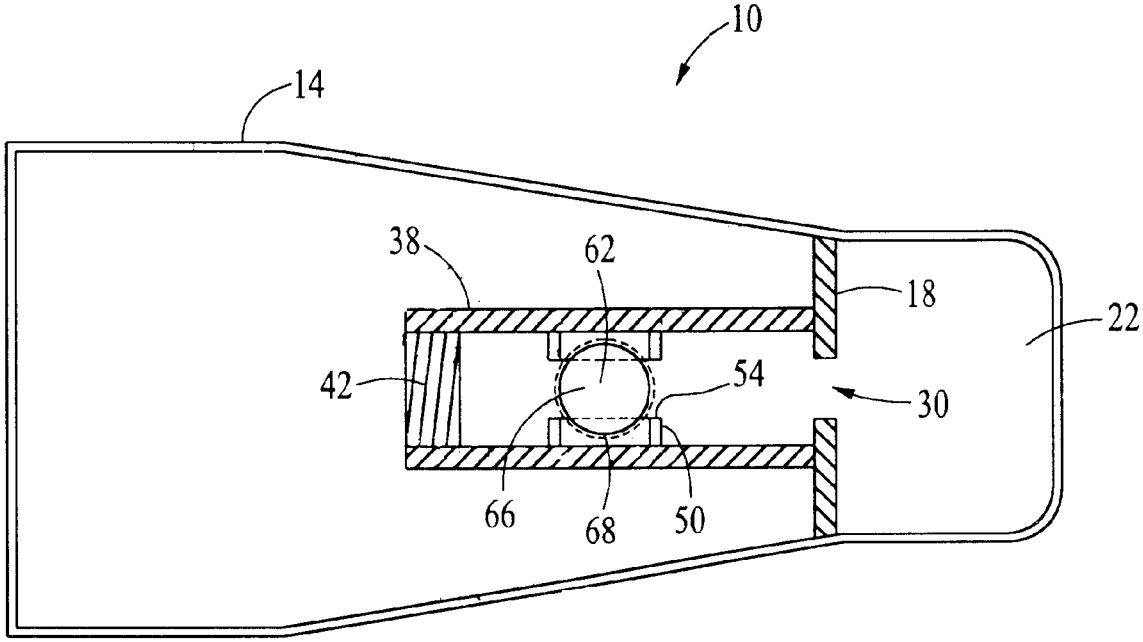
FIG. 2 is a horizontal cross-sectional view of the diverter tub spout of this invention with the ball valve open.

Referring to FIGS. 1 and 2, it can be seen that this invention 10 includes a hollow housing 14. The housing may be made of brass and its exterior provided with various decorative finishes such as chrome plating. The housing is divided inside by a web 18 to form a spout mouth 22, with an essentially right angular shape, and a connecting chamber 26. It will be readily understood that water issues from the spout mouth 22 in a downward direction. The shape of the spout mouth 22 conducts the initially horizontal stream of water from the horizontal to the vertical direction.

The web 18 has an orifice 30 through it. Attached to the rear 34 of the web 18, approximately concentrically around the orifice 30, is a ferrule 38 which is provided with female pipe threads 42 at its free end 46. It will be understood by those most familiar with the art to which this invention pertains that the female pipe threads 42 can be attached to a male threaded nipple, which is connected to the water supply, in conventional manner.

Approximately midway along the ferrule 38 there is a boss 50 which connects essentially diagonally across the ferrule 38. The boss 50 has a horizontal cylindrical bore 54 and a vertical cylindrical bore 58 through it. The vertical cylindrical bore 58 has one diameter d at its upper section and a slightly smaller diameter d' at its lower end. Seated in the vertical bore 58 is stem 62, with diameters d,d' matching those of the bore 58, which has a horizontal hole 66 through it. The horizontal hole 66 is the same diameter as the horizontal bore 54. Tolerances are arranged so that the stem 62 is able to rotate within the vertical bore 58 with a water tight seal. The smaller diameters d' at the lower end of the bore 58 and stem 62 create a shoulder 70 which prevents the stem 62 from falling through the bore 58. This arrangement ensures that the hole 66 and horizontal bore 54 remain co-planar. While not illustrated, there is also a device to prevent the stem 62 from being pulled out of the bore 58 and housing 14. Clearly, other arrangements are known and could be used to keep the stem 62 in proper place.

Figure 3:
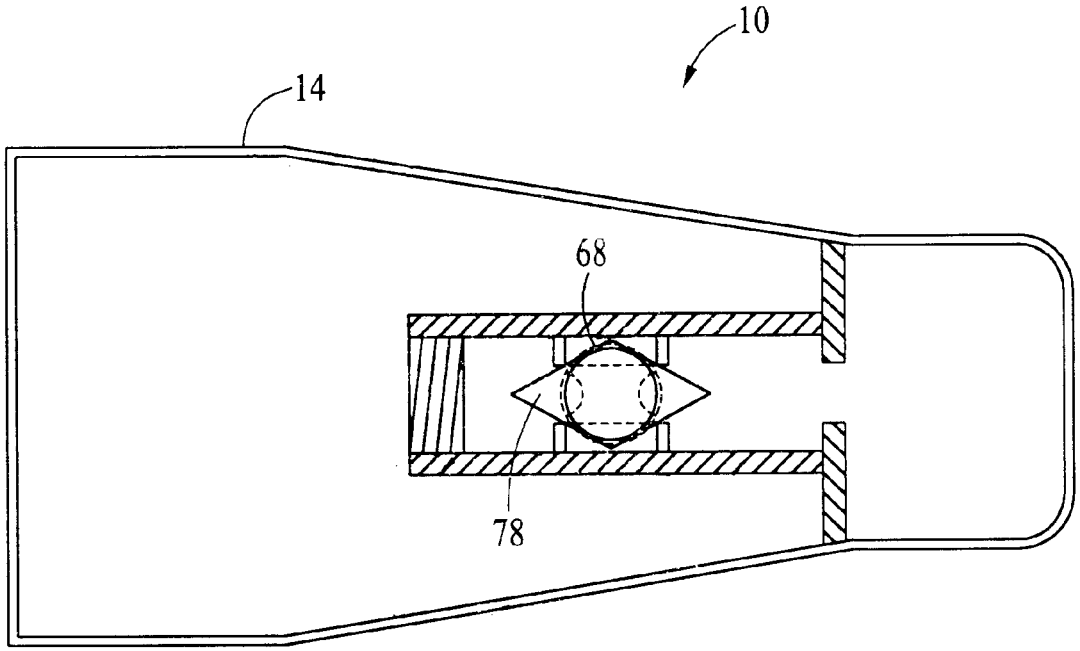
FIG. 3 is a top view of the diverter tub spout of this invention with the ball valve open.

The stem 62 protrudes through the top wall 74 of the housing. A handle 78, which is large enough for easy manipulation with a wet hand, is attached to the top 82 of the stem 62. The handle 78 is rotatable in the horizontal plane and may be shaped so as its position vis a vis the ferrule 38 can be easily determined. By shaped it is meant that the handle 78 is not just circular. In other words it could be bar or have an eccentric point incorporated into its circumference. A preferred design for the handle is shown in FIG. 3.

Figure 4:
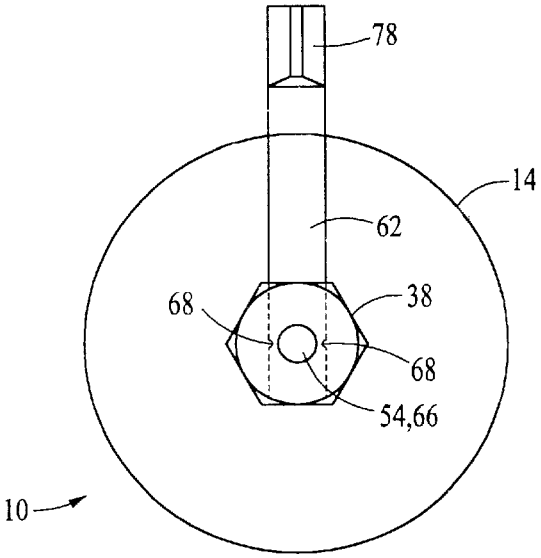
FIG. 4 is a rear view of the diverter tub spout of this invention with the ball valve open.
Figure 5:
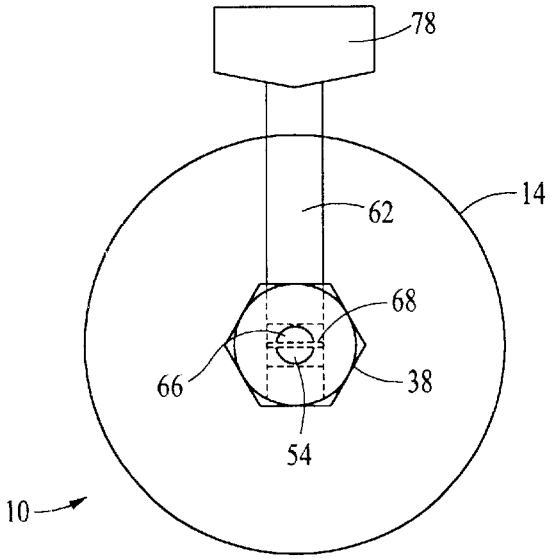
FIG. 5 is a rear view of the diverter tub spout of this invention with the ball valve closed.

Because of the constraints of the bore 58 through the boss 50 and the handle 78, the stem 62 can only rotate in the horizontal plane within the vertical bore 58. For purposes of this application, this construction will be designated as a ball valve 86. It can be seen that when the hole 66 in the stem 62 is in line with horizontal bore 54 in the boss 50, water can flow (i.e. the valve 86 is open) and when the hole 66 is cross wise to the horizontal bore 54, the water will not flow (i.e. the valve 86 is closed). The devices described above which keep the hole 66 through the stem 62 coplanar with the bore 54 through the boss 50 therefore keep the valve 86 aligned with the ferrule 38. When the handle 78 is shaped it is easy to determine by feel or glance whether the ball valve 86 is opened or closed. See FIGS. 4 and 5. In addition, the valve 86 is preferably designed to prevent water from standing in the shower riser for long periods. The simplest way to accomplish this is to place a score 68 in the stem 62 or bore 58. The score 68 allows the standing water to slowly seep past the stem 62 and into the spout 22, when water is shut off.

The web 18, ferrule 38, stem 62 and handle 78 can be made of a variety of materials such as brass and plastic. The stem 62 and handle 78 can also be provided with a decorative finish such as chrome. Those most familiar with the art to which this invention pertains will understand that the Figures and above description only describe the essential design and construction of this invention 10 and that, while not illustrated, bushings and washers, typically made of plastic can be incorporated to ensure the smooth working of the valve 86 with no water leakage.

Figure 6:
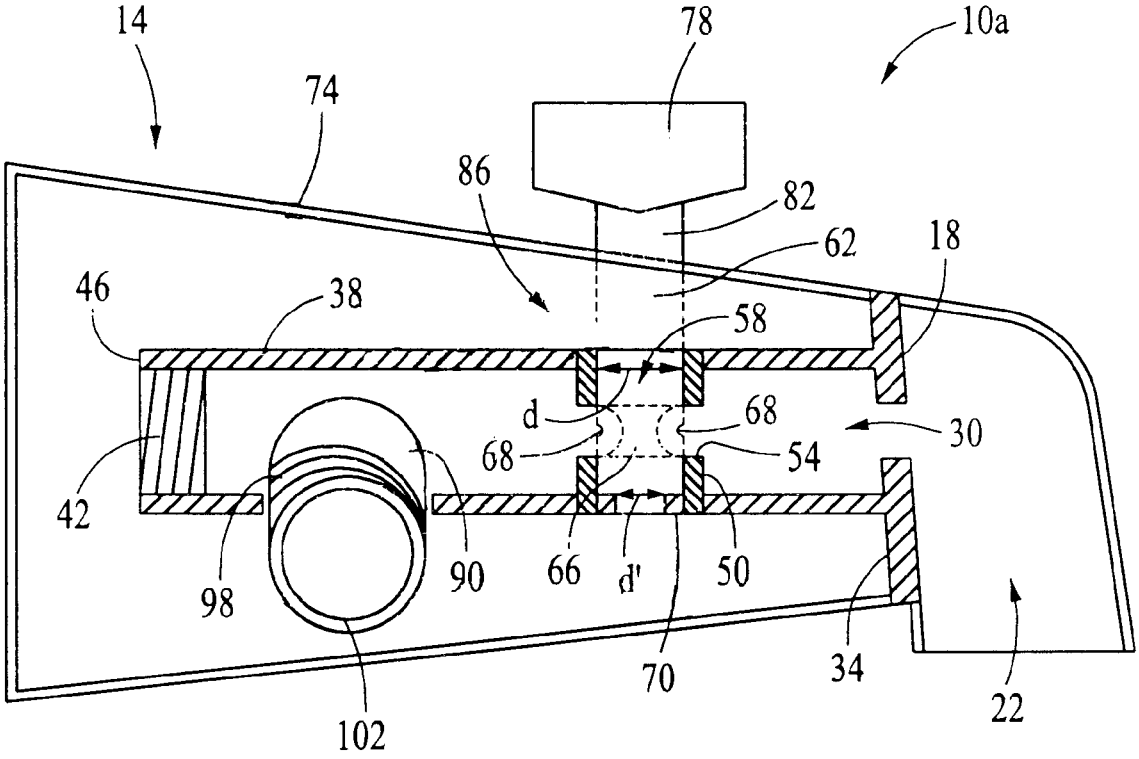
FIG. 6 is a vertical side view of the modified diverter tub spout of this invention with the ball valve open.
Figure 7:
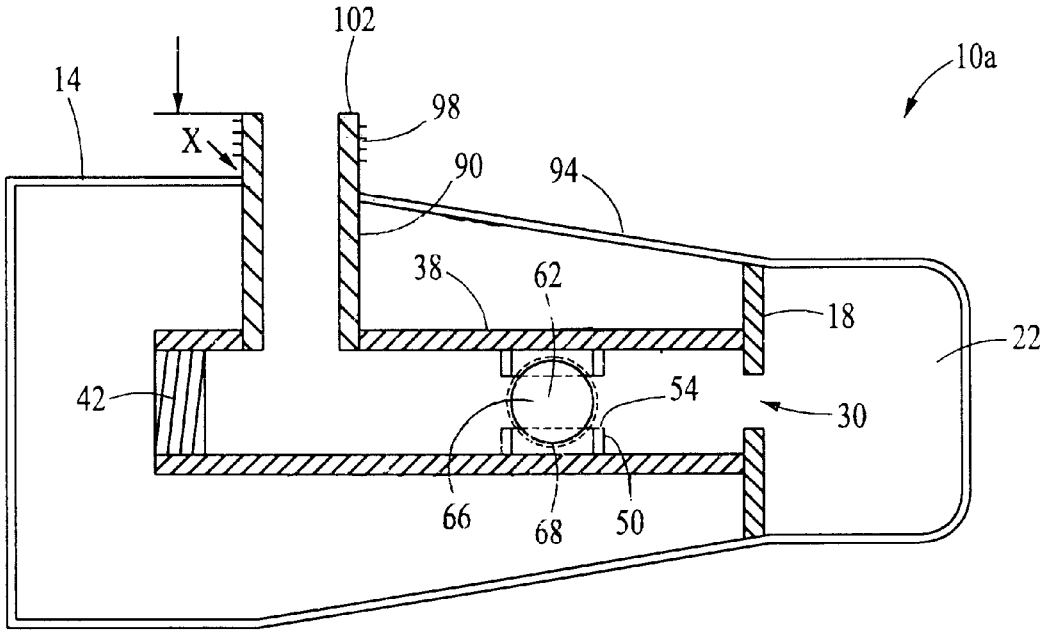
FIG. 7 is a horizontal cross-sectional view of the modified diverter tub spout of this invention with the ball valve open.

Referring to FIGS. 6 and 7, it can be seen that the modification or alternate embodiment 10*a* includes a hollow housing 14. The housing may be made of brass and its exterior provided with various decorative finishes such as chrome plating. The housing is divided inside by a web 18 to form a spout mouth 22, with an essentially right angular shape, and a connecting chamber 26. It will be readily understood that water issues from the spout mouth 22 in a downward direction. The shape of the spout mouth 22 conducts the initially horizontal stream of water from the horizontal to the vertical direction.

The web 18 has an orifice 30 through it. Attached to the rear 34 of the web 18, approximately concentrically around the orifice 30, is a ferrule 38 which is provided with female pipe threads 42 at its free end 46. It will be understood by those most familiar with the art to which this invention pertains that the female pipe threads 42 can be attached to a male threaded nipple, which is connected to the water supply, in conventional manner.

Approximately midway along the ferrule 38 there is a boss 50 which connects essentially diagonally across the ferrule 38. The boss 50 has a horizontal cylindrical bore 54 and a vertical cylindrical bore 58 through it. The vertical cylindrical bore 58 has one diameter d at its upper section and a slightly smaller diameter d' at its lower end. Seated in the vertical bore 58 is stem 62, with diameters d,d' matching those of the bore 58, which has a horizontal hole 66 through it. The horizontal hole 66 is the same diameter as the horizontal bore 54. Tolerances are arranged so that the stem 62 is able to rotate within the vertical bore 58 with a water tight seal. The smaller diameters d' at the lower end of the bore 58 and stem 62 create a shoulder 70 which prevents the stem 62 from falling through the bore 58. This arrangement ensures that the hole 66 and horizontal bore 54 remain co-planar. While not illustrated, there is also a device to prevent the stem 62 from being pulled out of the bore 58 and housing 14. Clearly, other arrangements are known and could be used to keep the stem 62 in proper place.

The stem 62 protrudes through the top wall 74 of the housing. A handle 78, which is large enough for easy manipulation with a wet hand, is attached to the top 82 of the stem 62. The handle 78 is rotatable in the horizontal plane and may be shaped so as its position vis a vis the ferrule 38 can be easily determined. By shaped it is meant that the handle 78 is not just circular. In other words it could be bar or have an eccentric point incorporated into its circumference. A preferred design for the handle is shown in FIG. 3.

Figure 8:
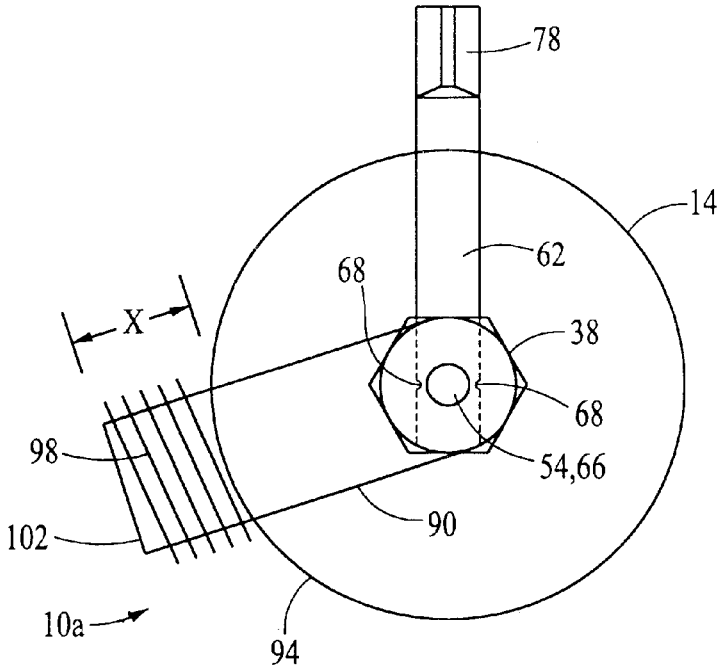
FIG. 8 is a rear view of the modified diverter tub spout of this invention with the ball valve open.
Figure 9:
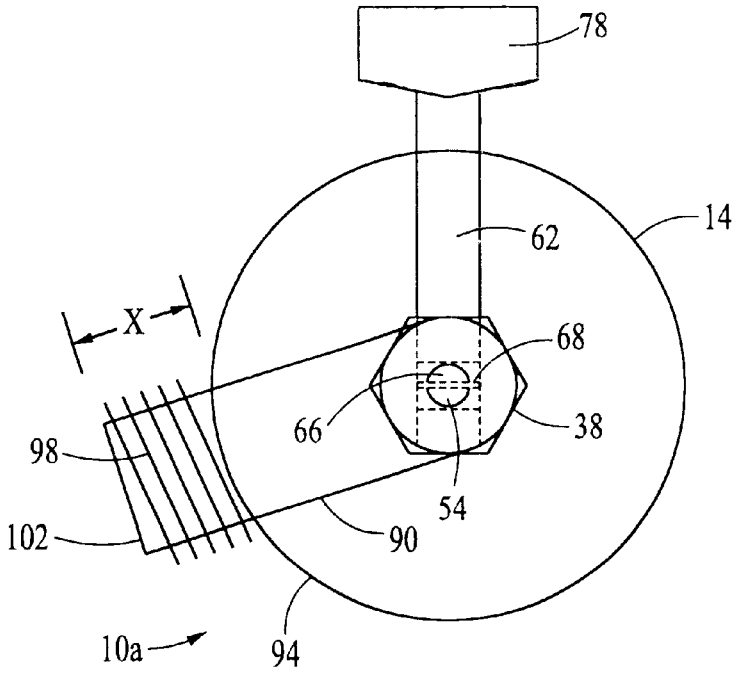
FIG. 9 is a rear view of the modified diverter tub spout of this invention with the ball valve closed.

Because of the constraints of the bore 58 through the boss 50 and the handle 78, the stem 62 can only rotate in the horizontal plane within the vertical bore 58. For purposes of this application, this construction will be designated as a ball valve 86. It can be seen that when the hole 66 in the stem 62 is in line with horizontal bore 54 in the boss 50, water can flow (i.e. the valve 86 is open) and when the hole 66 is cross wise to the horizontal bore 54, the water will not flow (i.e. the valve 86 is closed). The devices described above which keep the hole 66 through the stem 62 coplanar with the bore 54 through the boss 50 therefore keep the valve 86 aligned with the ferrule 38. When the handle 78 is shaped it is easy to determine by feel or glance whether the ball valve 86 is opened or closed. See FIGS. 8 and 9. In addition, the valve 86 is preferably designed to prevent water from standing in the hand held shower for long periods. The simplest way to accomplish this is to place a score 68 in the stem 62 or bore 58. The score 68 allows the standing water to slowly seep past the stem 62 and into the spout 22, when water is shut off.

A short pipe 90 is connected at a compound angle (approximately at right angles and downwards—see also, FIGS. 8 and 9) to the ferrule 38 before the female pipe threads 42. The pipe 90 passes through the side wall 94 of the hollow housing 14 and extends for a short distance X. Male pipe threads 98 are provided at the end 102 of the short pipe 90. The threads 98 enable connection of a hand held shower to the short pipe 90. Consequently, when the valve 86 is open, water can flow through the spout 22 and the short pipe 90 and when the valve 86 is closed, water can only flow through the short pipe 90.

The web 18, ferrule 38, stem 62, handle 78 and short pipe 90 can be made of a variety of materials such as brass and plastic. The stem 62, handle 78 and protrusion X of the short pipe 90 can also be provided with a decorative finish such as chrome. Those most familiar with the art to which this invention pertains will understand that the FIGS. 6–9 and above description only describe the essential design and construction of this modification 10*a* and that, while not illustrated, bushings and washers, typically made of plastic can be incorporated to ensure the smooth working of the valve 86 with no water leakage.

The following reference numerals are used on FIGS. 1 through 9:

10 Diverter tub valve
10*a* Modified diverter tub valve
14 Housing
18 Web
22 Spout mouth
26 Connection chamber
30 Orifice through web
34 Rear of web
38 Ferrule
42 Female pipe threads
46 Free end of ferrule
50 Boss
54 Horizontal bore through boss
58 Vertical bore through boss
62 Stem
66 Horizontal hole through stem
68 Score
70 Shoulder
74 Top wall of housing
78 Handle
82 Top of stem
86 Ball valve sub assembly
90 Short pipe
94 Side wall of housing
98 Male threads adapted for connection to a hand held shower
102 End of short pipe
d Upper diameter of vertical bore through boss and stem
d' Lower diameter of vertical bore through boss and stem
X Protrusion of short pipe The diverter tub valve 10, 10*a* has been described with reference to particular embodiments. Other modifications and enhancements can be made without departing from the spirit and scope of the claims that follow.

What is claimed is:

1. A diverter tub valve comprising:

a. a housing divided into a spout mouth and a connection chamber;

b. an interior web, dividing said spout mouth from said connection chamber; said interior web having an orifice through it;

c. a ferrule, having a free end, connected to said interior web approximately concentrically around said orifice; said free end carrying female pipe threads;

d. a ball valve, including a horizontally rotatable handle, approximately midway along said ferrule; said handle being positioned above said housing; and e. means for keeping said ball valve aligned with said ferrule.

2. A diverter tub valve as claimed in claim 1 in which said handle is shaped so that the position of said ball valve can be easily determined.

3. A diverter tub valve as claimed in claim 1 further comprising a short pipe joined to said ferrule at a compound angle; said short pipe passing through said housing and protruding for a short distance; said short pipe having an end; said end provided with male pipe threads adapted for connection of a hand held shower.

* * * * *